US005207746A

United States Patent [19]

Jones

[11] Patent Number: 5,207,746

[45] Date of Patent: May 4, 1993

[54] PACKAGE LABEL

[75] Inventor: Donald Jones, Long Grove, Ill.

[73] Assignee: Pharmagraphics, Inc., Greensboro, N.C.

[21] Appl. No.: 893,646

[22] Filed: Jun. 4, 1992

[51] Int. Cl.[5] ..... B42D 15/00

[52] U.S. Cl. ..... 283/81; 283/56; 40/299; 40/310; 40/306

[58] Field of Search ..... 283/81, 94, 101, 103, 283/105, 56; 40/299, 306, 310, 360, 630, 638; 428/42, 43

[56] References Cited

U.S. PATENT DOCUMENTS

| | | | |
|---|---|---|---|
| 1,273,105 | 7/1918 | Van Dyke et al. | 281/29 |
| 4,323,608 | 4/1982 | Denny | 40/310 X |
| 4,529,229 | 7/1985 | Glibbery | 283/81 |
| 4,621,837 | 11/1986 | Mack | 283/56 X |
| 4,744,161 | 5/1988 | Instance | 40/310 X |
| 4,868,027 | 9/1989 | Hunkeler et al. | 40/630 X |

*Primary Examiner*—Mark Rosenbaum

*Assistant Examiner*—Willmon Fridie, Jr.

*Attorney, Agent, or Firm*—Rhodes, Coats & Bennett

[57] ABSTRACT

A label construction formed of a first bottom panel with an adhesive backing for affixation to a pharmaceutical container and ad second series of panels in the form of a folded leaflet. The first panel contains product identifying indicia thereon as well as an indicated area for the pharmaceutical or chemical manufacturer to place statutory information relating to lot number and expiration date. A second panel is separated from the first panel by a transverse fold line. The second panel contains substantially the same label indicia without the indicated area for the statutory information. A plurality of further panels which contain printed instructional information are attached to the second panel and folded together between the first and second panels. The second and successive panels are separated from the first panel by the consumer along a tear line situated between the first and second panels and become a folded literature leaflet.

8 Claims, 2 Drawing Sheets

PACKAGE LABEL

BACKGROUND AND SUMMARY OF THE INVENTION

The present invention is directed to a package label for pharmaceutical, agricultural, and/or chemical packages, and, more specifically, to a package label of the type which contains, in addition to the identifying base label, folded printed literature on a removable leaflet affixed to the exterior of the package, as opposed to being placed within the package.

In the packaging of certain chemicals and pharmaceuticals, the manufacturer is often required or desires to provide a considerable amount of information concerning the chemical or pharmaceutical. In the case of pharmaceuticals, this is required by government regulations, however, the occasion may also arise, either separate from or in conjunction with government regulations, to provide the doctor, pharmacist or user with instructions on how the product should be used, what the product is, and safety precautions which should be followed in the use of the product. Sometimes the literature, which is generally in the form of folded leaflets, is placed within a box along with the container carrying the chemical or pharmaceutical (referred to as "inserts"). The placement of leaflets within the box is expensive and a cumbersome operation to perform. Also, it is difficult to insure by later inspection that the proper literature has been inserted in the proper package.

A different approach to solving this problem has developed over the last several years in which the folded literature is releasably attached to the face of the container (referred to as "outserts"), either directly to the container itself, or to a base label which, in turn, is secured to the container. The literature may then be removed by the customer. In such cases, the portion of the label remaining must carry both an "identification" of the product defined as information such as trademark, manufacturer, etc., as well as certain "statutory information" (defined as lot number and expiration date).

Thus, in order to meet the objectives of such labeling techniques, certain criteria must be met. First of all, the portion of the label which remains after the folded literature is removed must contain both the identification of the product, as well as the statutory information concerning the lot number and expiration date. Further, after the literature leaflet is assembled or affixed to the base label, the indicated area for statutory information concerning lot number and expiration date must be accessible for stamping or printing by the pharmaceutical company and visible to the consumer in addition to the identification of the product. The folded leaflet portion remains affixed to the label portion until the customer (doctor, pharmacist, consumer) desires its removal. It is critical that the proper literature must be affixed to the proper base label. Finally, all of the above criteria must be accomplished in a manufacturing technique that insures quality and is cost-effective.

Examples of types of labels in the prior art which have addressed this problem are described in U.S. Pat. Nos. 1,273,105 to VanDyke et al.; 4,621,837 to Mack; and 4,323,608 to Denny et al. They are examples of labels which have removable portions affixed thereto. However, the labels of VanDyke et al., Mack, and Denny et al. are constructed differently and operate differently than those of the instance invention.

The present invention, on the other hand, is directed to a label construction whereby the base portion which carries the identifying indicia and an indicated area(s) for statutory information and the printed literature leaflet are all combined into a single unitary label. Toward this end, the label of the present invention is formed entirely from a unitary paper blank divided into a plurality of panels defined by fold lines. A first panel (which becomes the base panel) at one end of the paper blank has a lower non-adhesive face with a prescribed printed indicia thereon and an upper face which has adhesive applied thereto. A second or front panel lies adjacent the base panel and also includes a prescribed printed indicia on the upper surface thereof adjacent the upper face of the first panel which has the adhesive substance applied thereto. A tear line extends parallel to and adjacent the fold line between the first and second panels. A third panel is provided adjacent the second panel and folded thereunder between the first and second panels. The third panel includes one or more adhesive areas (spots) adjacent to the fold line between the second and third panels for temporarily holding the free edge of the folded leaflet in place against the front surface of the base panel until the folded literature is removed. A plurality of further panels are attached to the third panel and folded together in position behind the second panel whereby the label may be applied as a unit to a product. The consumer can then separate the folded leaflet portion from the base label by tearing along the aforementioned tear line so that the leaflet is removed and the base label remains affixed to the product for identification thereof. The base panel is larger than any of the other panels and includes an indicated area(s) for the stamping of statutory information thereon concerning lot number and expiration date in addition to identifying information.

The exposed face of the base label and the exterior of the front or second panel carries substantially the same identifying matter thereon. Each of the third and successive panels are preferably slightly smaller than the previous panel.

So arranged, the label of the present invention may be applied as a unit to a bottle, box or other container. The label with the folded literature portion are formed as an integral unit to the container. After purchase, the folded leaflet portion may be torn along the tear line and removed from the remainder of the label. The remaining portion of the label, which becomes the base label, remains affixed to the product for identification thereof.

It is therefore an object of the present invention to provide an improved label construction for labels of the type which include a permanent identifying portion and a removable folded leaflet portion.

It is another object of the present invention to provide an improved label of the type described in which the base label and folded literature portion are fabricated integrally, applied to the carton or container in one operation, then separated by the consumer.

Other objects and a fuller understanding of the invention will become apparent upon reading of the following detailed description of a preferred embodiment along with the accompanying drawings in which.

DETAILED DESCRIPTION OF A PREFERRED EMBODIMENT

Figure 1:
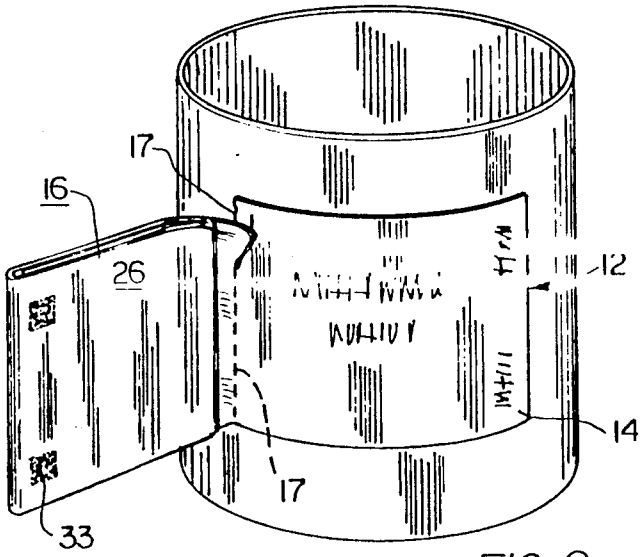
FIG. 1 is a perspective view of the label construction according to the present invention in its intended environment.
Figure 2:
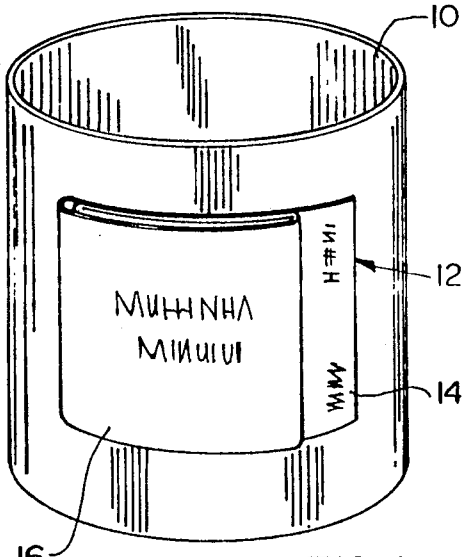
FIG. 2 is a perspective view similar to FIG. 1, except showing the container with the base portion of the label affixed thereto as the folded leaflet is being removed.

Turning now to the drawings, and referring to FIGS. 1 and 2, there is illustrated a container 10, which may be round, rectangular, or may assume any prescribed shape and be formed of any material. A label 12 as envisioned by the present invention is affixed to the surface of the container. As has been previously described, the label 12 includes both a base label portion 14 and a folded leaflet portion 16 of printed instructional literature. When purchased, the customer receives the container 10 with the label 12 affixed thereto as illustrated in FIG. 1. The customer then removes the printed leaflet 16 from the base label 14. As used herein, the "customer" may be a doctor, pharmacist, or ultimate consumer.

Figure 3:
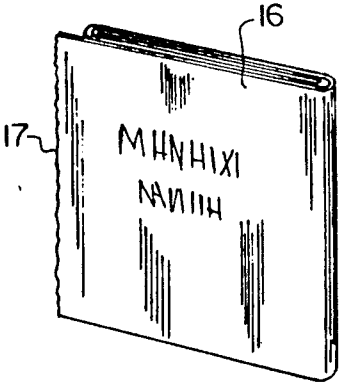
FIG. 3 is a perspective view of the folded literature portion removed from the base portion of the label.

As illustrated in FIGS. 2 and 3, the leaflet is removed by first lifting the right-hand edge of the leaflet 16 which has been temporarily affixed to the face of base label 14. Then the leaflet 16 is removed by tearing along tear line 17, which extends along the left-hand side of the label configuration.

Once the printed leaflet 16 is removed, it is available for unfolding and reading. The outer or top surface of printed leaflet 16 contains identifying indicia thereon. The same identifying indicia also appears on the remaining surface of base label 14, once the printed leaflet has been removed (see FIG. 2). The only difference between the printed indicia on the upper surface of base label 14 and that of the outer surface of printed leaflet 16 is that the base label 14 also contains an indicated area(s)d for the placement of statutory information pertaining to lot numbers and expiration dates. This area is visible on the right-hand end of base label 14, and is visible whether or not the printed leaflet 16 has been removed.

Figure 4:
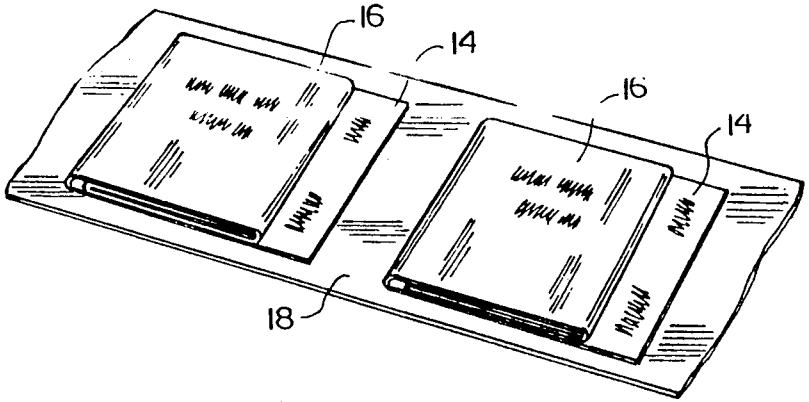
FIG. 4 is a perspective view of a plurality of labels of the present invention separate from the container and assembled onto a web of release paper.

In FIG. 4, there is illustrated the label construction 12 removed or prior to affixation to container 10. The base label portion 14 has adhesive on the reverse side thereof. The labels 12 are preferably affixed to a web 18 of release paper (silicon treated). Alternatively, the labels 12 could be stored and fed separately through a suitable magazine past an adhesive applying station and onto the pharmaceutical or chemical package. Also, as indicated hereinabove, the printed leaflet portion is spot-glued or semi-permanently affixed to the base label 14 as will be explained hereinafter.

Figure 5:
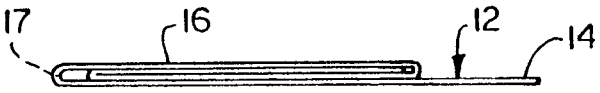
FIG. 5 is a sectional view taken substantially along lines 5—5 in FIG. 4.

FIG. 5 is a sectional view taken from FIG. 4 and illustrates the spiral or continuous wrap type of folding. The folds forming the underneath portion of the printed leaflet may also be formed with adjacent panels folded in the opposite direction.

Figure 6:
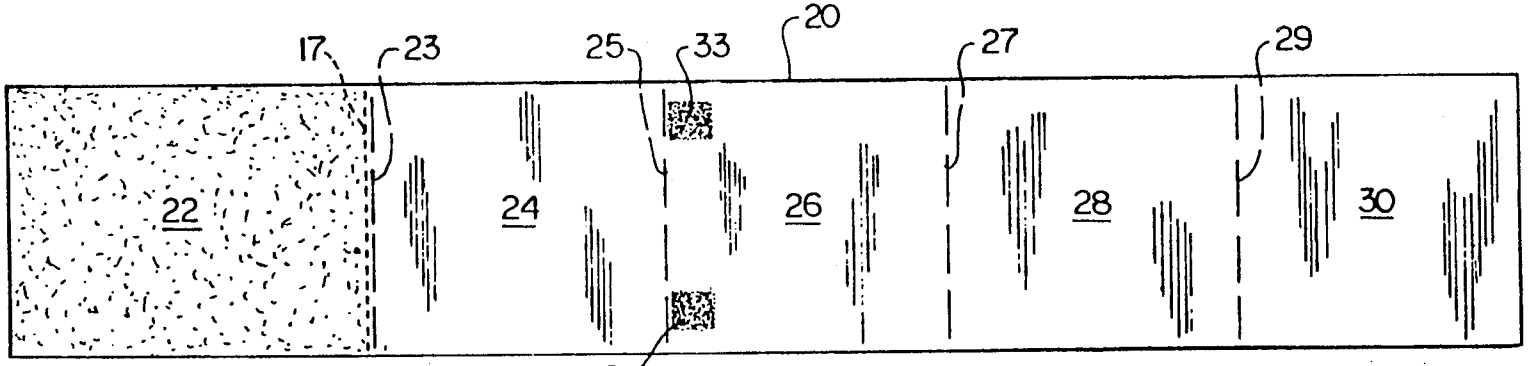
FIG. 6 is a plan view of the label blank prior to its being folded and affixed to the container.
Figure 7:
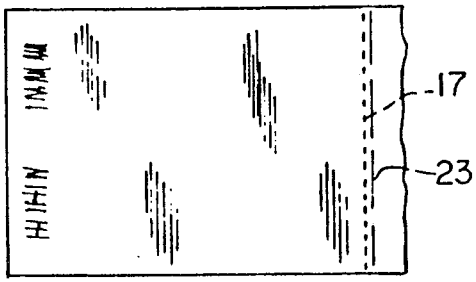
FIG. 7 is a plan view of the underside of the first panel, with the remainder of the label broken away.

In FIGS. 6 and 7, there is shown the blank 20 from which label 12 is formed in its open configuration, which comprises a series of panels 22, 24, 26, 28, 30 separated by a plurality of fold lines 23, 25, 27, 29. The first or left-hand panel 22 of FIG. 6 becomes the base label 14. In FIG. 6, the surface of panel 22 being viewed is the surface to which the adhesive is applied. The underside or reverse surface (FIG. 7) is the printed surface of what becomes the base label. It is the surface on which is printed the identifying material and includes the area(s) for the statutory information shown in FIG. 2. The second panel 24, which is immediately adjacent the first panel 22 and separated therefrom by fold line 23, becomes the upper or exposed surface of the label 12 when applied to the container (FIG. 1). A tear line 17 is formed on either panel 22 and panel 24 immediately adjacent fold line 23. Thus, the product identification indicia on surface 24 is substantially identical to the product indicia information which appears on the reverse side of the first panel 22 (see FIG. 7).

The third panel 26 is separated from second panel 24 by fold line 25. A pair of adhesive dots or adhesive stripe 33 on panel 26 adjacent fold line 25 enable the folded leaflet 16 to be semipermanently affixed to the face of base label 12 as previously described. However when the customer so desires, the folded leaflet 16 is easily removed from base label 12 by lifting the folded leaflet which separates at the adhesive areas 33 from base panel 22, then by tearing the leaflet 16 along the tear line 17 which is placed immediately adjacent the fold line 23 (see FIG. 2).

The remaining panels 28, 30 are separated from the previous panels by fold lines 27, 29 respectively. There may be as many further panels as desired to contain the descriptive and instructional literature.

Labels 12, as illustrated in FIG. 4, are printed and folded with the adhesive portions 33 causing a semi-permanent affixation of the folded leaflet portion 16 to the base label portion 14. In accordance with conventional techniques, the labels 12 have adhesive placed on the rear surface thereof (panel 22), and the labels 12 are temporarily affixed to a web of release material, which is manufactured, stored and shipped in reels or stacked in a container accordion-style. The pharmaceutical or chemical manufacturer then applies the entire label 12 to containers 10 in a continuous operation.

The products are then sold to customers who, as described hereinabove, remove the folded leaflet by tearing along the tear line 17. The base label 14 remains with the container 10 and identifies the product, as well as giving statutory material to the doctor, pharmacist or consumer, such as lot number and expiration date. The folded leaflet is also identified by the second or exposed panel 24 which carries substantially the same identifying indicia as is present on the exposed surface of base label 14.

In addition to providing improved and economically attractive advantages, the label is particularly susceptible to economical automated manufacturing, resulting in great improvement and economy, manufacturing volume, and minimizing wasted paper. Further, it is not necessary to manufacture separately and assemble the folded leaflets to the base label. The entire process is printed and folded at once.

While a preferred embodiment of the invention has been described in detail hereinabove, it is apparent that various changes might be made without departing from the scope of the invention as set forth in the claims below.

What is claimed is:

1. A unitary label of the type including a base portion on which can be printed product identifying matter as well as such statutory material as the lot number and/or manufacturing date, and a folded instruction leaflet on which can be imprinted information concerning the content and use of the product, said label construction comprising:

a. a paper blank divided into a plurality of panels defined by fold lines;

b. said plurality of panels including:

i. a first or base panel having a non-adhesive front surface with a prescribed printed indicia thereon and an opposite rear surface which has adhesive applied thereto;

ii. a second or front panel adjacent said base panel and having a prescribed printed indicia on the front surface adjacent the adhesive surface and opposite the non-adhesive printed surface of said first panel;

iii. a tear line extending parallel to and adjacent the fold line between said first and second panels;

iv. a third panel adjacent said second panel and folded thereunder between said first and second panels, said third panel including one or more adhesive areas adjacent the fold line between said second and third panels for holding the free edge of said folded instructional leaflet in place against said front surface of said base panel until said folded instructional leaflet is removed;

v. a plurality of further panels folded together and positioned between said first and second panels;

c. whereby said label may be applied as a unit to a product and then the folded instructional leaflet portion may be torn along said tear line and removed from the base label, with the base label remaining affixed to said product for identification thereof.

2. The label construction according to claim 1 wherein the front surface of said base panel and the front surface of said front panel carry substantially the same identifying matter.

3. The label construction according to claim 1 wherein a plurality of said labels are affixed to a web of release paper.

4. The label construction according to claim 1 wherein said plurality of further panels are folded together as a flattened spiral.

5. The label construction according to claim 1 wherein each of said third and successive panels are slightly shorter in length than the previous panels.

6. A unitary label comprising a base portion and a folded leaflet formed as one integral unit from a single blank, said base portion having identifying information and an indicated area(s) set aside for statutory information printed on the front surface thereof and adhesive applied to the under surface thereof for securing said base portion to a package, said folded leaflet having a front surface and formed integrally with said base portion and connected along a fold line on one side thereof to said base portion, the edge of said folded leaflet opposite said fold line being temporarily affixed to the upper surface of said base portion, said base portion having a portion thereof extending outwardly beyond said folded leaflet and carrying said indicated area(s) for statutory information.

7. The label according to claim 6 wherein the front surface of said base label and the front surface of said front panel carry substantially the same identifying matter.

8. The label according to claim 6 wherein a plurality of said labels are affixed to a web of release paper.

* * * * *